United States Patent [19]

Fronius

[11] 4,306,620

[45] Dec. 22, 1981

[54] TRI-SPACER

[76] Inventor: Joseph H. Fronius, 9653 W. Purdue Ave., Peoria, Ariz. 85345

[21] Appl. No.: 125,156

[22] Filed: Feb. 27, 1980

[51] Int. Cl.[3] ..... E21B 19/10

[52] U.S. Cl. ..... 166/241; 285/421; 403/368; 403/374

[58] Field of Search ..... 166/241; 403/374, 367, 403/369, 365, 368; 24/263 D; 285/421

[56] References Cited

U.S. PATENT DOCUMENTS

| | | | |
|---|---|---|---|
| 1,514,327 | 11/1924 | Krause | 285/421 X |
| 2,828,147 | 3/1958 | Peiffer | 285/421 X |
| 3,933,203 | 1/1976 | Evans | 166/241 |

*Primary Examiner*—William F. Pate, III
*Attorney, Agent, or Firm*—Hugh D. Jaeger

[57] ABSTRACT

Tri-spacer for centering and holding drop pipe and electric wires in the center of a well casing. The tri-spacer consists of a one-piece triangular member with flexible ends providing a centering action with very little constriction, binding, or drag on the well casing when the drop pipe and electric wires are lowered or raised in the well, and at the same time keeping the drop pipe and electric wires centered. The tri-spacer includes an insert wedge for locking action to the well casing and a sharp annular ridge on the inner diameter of the tri-spacer making an impression in the drop pipe.

15 Claims, 5 Drawing Figures

TRI-SPACER

BACKGROUND OF THE INVENTION

1. Field of the Invention

The present invention relates to well pipes and, more particularly, pertains to a tri-spacer for spacing a drop pipe and associated electric control wires in the center of a well casing.

2. Description of the Prior Art

The prior art devices consist of circular members that caused considerable constriction during raising and lowering in the well casing. The device had no means of fastening to the drop pipe, and had to be held in place by using friction tape which is quite expensive and cumbersome. Also, the electric wires had to be fed through a hole of each unit which is very laborious. The prior art devices left much to be desired, especially since the drop pipe could rub against the well casing and subsequently leak, and electric control wires could rub and subsequently short out.

The present invention overcomes the disadvantages of the prior art by providing a tri-spacer to space a drop pipe from a well casing.

SUMMARY OF THE INVENTION

The present invention provides a tri-spacer having a triangular member with a plurality of triangular flexible ends providing centering action with very little constriction, binding or drag on the wall of the well casing when it is lowered or raised because only two points touch the casing as the tri-spacer tilts causing two ends to hold tighter while at the same time providing free movement through the well casing as the triangular ends are flexed.

According to one embodiment of the present invention, there is provided a tri-spacer triangular member including a plurality of flexible ends spaced for being accepted internally in a well casing, an inner hole substantially in the center which accepts the drop pipe, a hole off to one side for accepting electric control wires, an inner ridge extending substantially around the diameter of the inner hole, and a serrated locking wedge connected by a tab to the tri-spacer whereby the tri-spacer spaces the drop pipe from the well casing with the triangular members. The offset hole provides for the electric control wires and the serrated locking wedge and inner ridge lock engage the tri-spacer to the drop pipe.

A significant feature of the present invention is that the tri-spacer is simply and quickly fastened to the drop pipe by inserting the attached wedge. The plastic material lets the tri-spacer shrink tighter on the drop pipe when it is placed in the cooler water in the well casing.

Another significant aspect and feature of the present invention is the slotted hole for holding the electric wires which allows the wires to be easily assembled and securely fastened to keep the electric control wires from rubbing on the well casing.

Other aspects and features of the present invention are that the drop pipe and electric control wires are equally spaced at a plurality of points from the well casing.

BRIEF DESCRIPTION OF THE DRAWINGS

Other objects and many of the attendant advantages of this invention will be readily appreciated as the same becomes better understood by reference to the following detailed description when considered in connection with the accompanying drawings, in which like reference numerals designate like parts throughout the FIGURES thereof and wherein.

DESCRIPTION OF THE PREFERRED EMBODIMENT

Figure 1:
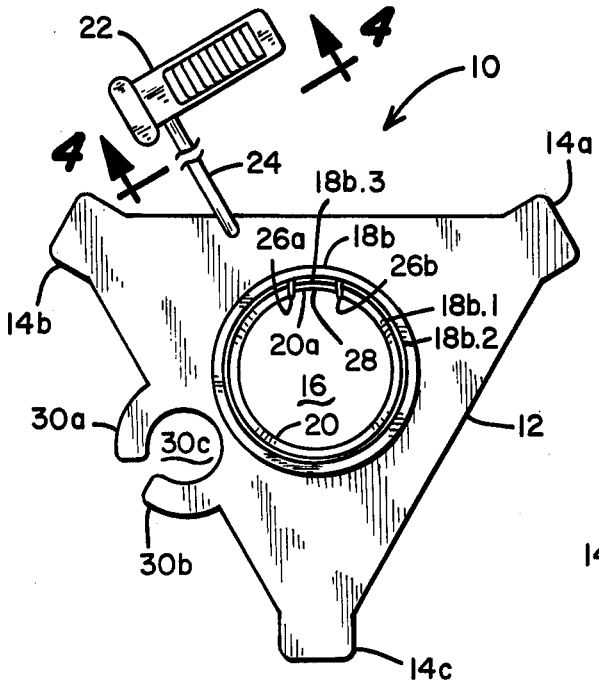
FIG. 1 illustrates a bottom plan view of a tri-spacer, the present invention.
Figure 2:
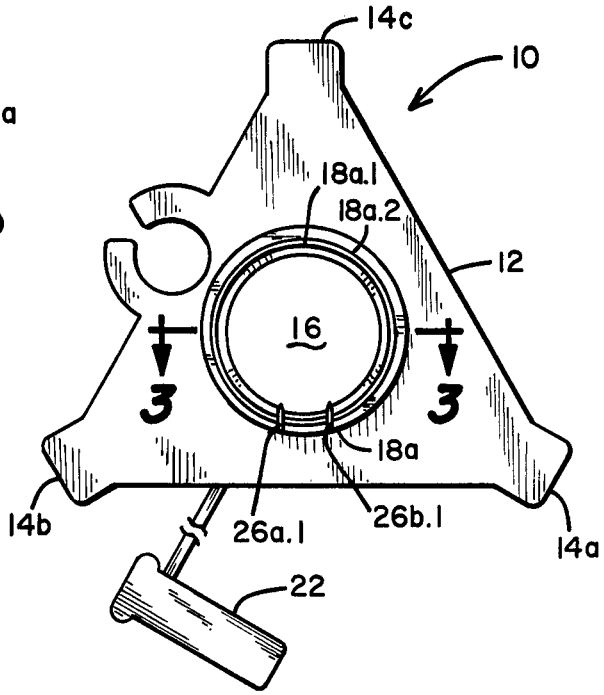
FIG. 2 illustrates a top plan view of the present invention.
Figure 5:
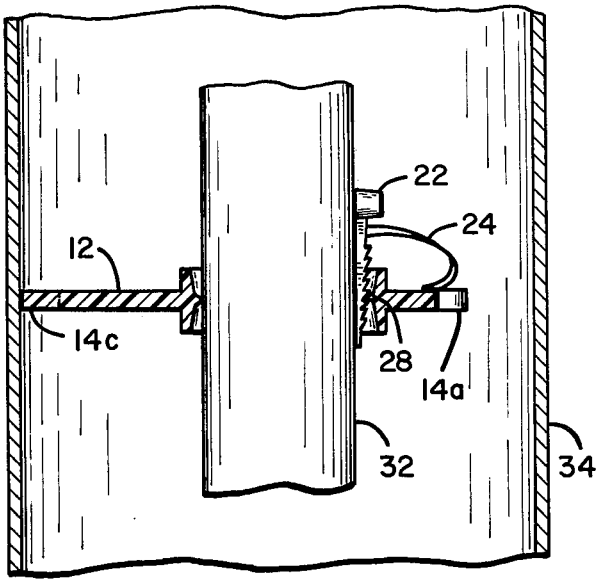

FIG. 1, which illustrates a bottom plan view of a tri-spacer 10, the present invention, shows a tri-spacer 10 having a geometrical triangular configuration 12 by way of example and for purposes of illustration only. A plurality of tabs 14*a* through 14*c* extend outwardly adjacent the apex of the triangular member. An internal hole 16 is positioned in the center of the triangular member 12. The internal hole 16 has a diameter which is slightly larger than the outer diameter of a drop pipe, as later described in detail in FIG. 3. An upper rim 18*a* of increasing internal diameter, as illustrated in FIG. 2, and a lower rim 18*b* of increasing internal diameter extend upwardly and downwardly from the internal hole as illustrated in FIG. 2. The lower rim decreases from a small inner diameter 18*b*.1 to a large inner diameter 18*b*.2. A channel 18*b*.3 is formed in the lower rim for accepting the insert wedge 22 as later described in detail. A triangular sharp-pointed ridge 20 extends substantially around the diameter of the internal hole 16 and provides for a gap 20*a* for a serrated insert wedge 22 secured to the geometrical triangular member 12 by a strap 24. The serrated insert wedge 22 includes a plurality of locking serrations 22*a* through 22*k*, an enlarged end 221 and a pointed end 22*m*. A plastic strap 24 connects the serrated insert wedge 22 to the geometrical triangular member 12. Vertical guide ridges 26*a* and 26*b* extend on the upper and lower rims 18*a* and 18*b* respectively. Horizontal ramp locking ridge 28 as illustrated in FIG. 5 extends across the gap 20*a*. Hooks 30*a* and 30*b* extend outwardly from one side of the geometrical member and form a hole 30*c* which extends partially into the geometrical member 12 providing a hole 30*c* for electrical control wires. The hooks 30*a* and 30*b* can be on any one of the geometrical sides of the geometrical member.

FIG. 2 illustrates a top plan view of the tri-spacer 10 where all numerals correspond to those elements previously described. Horizontal locating ridges 26*a*.1 and 26*b*.1 provide a visual and digital feedback device for inserting the serrated insert wedge 22.

Figure 3:
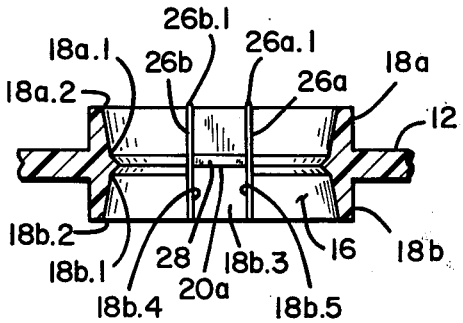
FIG. 3 illustrates a partial cross-sectional view taken on line 3—3 of FIG. 2.

FIG. 3, which illustrates a sectional view taken along line 3—3 of FIG. 2, shows a partial vertical plan view of the internal hole 16 where all numerals correspond to those elements previously described. The channel 18*b*.3 includes channel ridges 18*b*.4 and 18*b*.5.

Figure 4:
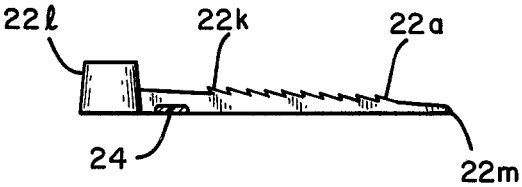
FIG. 4 illustrates a cross-sectional view taken along line 4—4 FIG. 1; and, FIG. 5 illustrates a cross-sectional view of the tri-spacer spacing a drop pipe in a well casing.

FIG. 4, which illustrates a sectional view taken along line 4—4 of FIG. 1, shows a side view of the serrated insert ridge 22, where all numerals correspond to those elements previously described.

FIG. 5 illustrates a cross-sectional view of the tri-spacer 10 spacing the drop pipe 32 from the well casing 34.

PREFERRED MODE OF OPERATION

The tri-spacer 10 is a centering device which lines a drop pipe 32 and electric control wires not illustrated in the FIGURES for purposes of clarity in the drawing in the center of a well casing 34. Tri-spacer 10 keeps the drop pipe 32 from rubbing on or against the sidewall of the well casing 34. Tri-spacer 10 also positions electric control wires to be securely fastened within the hole 30*c* of the tri-spacer preventing the wires from touching the well casing 34.

The triangular geometrical member 12 provided with the flexible tabular ends 14*a* through 14*c* provides centering action with little or no constriction, binding or drag on the well casing 34 when it is lowered or raised because only two triangular tabs engage against the well casing 34 at any time during raising or lowering due to the increasing internal diameters of the upper and lower rims 18*a* and 18*b* respectively. When the two triangular tabs do engage against the well casing 34, the tri-spacer 10 tilts causing it to frictionally engage at the two engaging tabular ends while at the same time providing free movement through the well casing as the ends are flexed.

The triangular, sharp pointed ridge 20 frictionally engages against and into the drop pipe 32 firmly engaging the tri-spacer 10 at the predetermined location on the drop pipe 32. Also the nature of the material of tri-spacer 10 such as any thermo plastic injected molded material or other like material has a surgent shrinking action on the drop pipe 32 when it is placed in a cooler liquid such as water and in the cool well casing.

The serrated insert wedge 22 provides further frictional engagement of the tri-spacer 10 on the drop pipe 32 and the insert wedge has the plurality of locking serrations 22*a* through 22*k* which frictionally engage and mate with the horizontal ramp locking ridge 28 and in the channel 18*b*.3 which provides the tri-spacer 10 to be frictionally engaged against the drop pipe 32. Vertical guide ridges 26*a* and 26*b* provide for vertical alignment of the insert wedge 22. Horizontal locating ridges 26*a*.1 and 26*b*.1 are provided for locating of the insert wedge at the tri-spacer 10. For purposes of convenience, the insert wedge 22 is attached to the triangular member 12 with a plastic strap 24. Insert wedge 22 is also provided with an enlarged end 221 for easy handling and a pointed end 22*m* for easy engagement into the tri-spacer 10.

Electrical control wires are positioned within the hooks 30*a* and 30*b* through the hole 30*c* which serves to securely hold the electrical control wires away from the well casing 34.

Various modifications can be made to the present invention without departing from the apparent scope thereof. For instance, the geometrical triangular member may take any geometric shape and the geometric member 12 may be provided with any plurality of tabs. The overall physical size of the tri-spacer 10 can be made to accommodate any diameter of well casing and drop pipe depending upon the particular diameters being utilized.

Having thus described the invention, what is claimed is:

1. Tri-spacer for spacing a drop pipe in a well casing comprising:

a. plurality of tabular means extending equally outward from a center of a geometrical member for equally engaging against an interior of a well casing;

b. an internal hole centrally positioned in said member for accepting said drop pipe, said internal hole including an upper and lower rim, each of said rims having an increasing internal diameter from said center to an outer edge of said rims; and, c. locking means for engaging between said internal hole and said drop pipe whereby said locking means maintains said tri-spacer in a predetermined position on said drop pipe when said drop pipe is slid down into said well casing.

2. Tri-spacer of claim 1 wherein said geometrical member is substantially triangular.

3. Tri-spacer of claim 1 wherein said plurality of tabular means comprises at least three.

4. Tri-spacer of claim 2 wherein said tabular means comprises a substantially rectangular member extending outwardly from each apex of said triangular member.

5. Tri-spacer of claim 1 wherein said member includes partially enclosed hooks extending from said member whereby said hooks frictionally engage electric control wires.

6. Tri-spacer of claim 1 wherein said member is plastic including the property of shrinking when immersed in cold liquid.

7. Tri-spacer for spacing a drop pipe in a well casing comprising:

a. plurality of tabular means extending equally outward from a center of a geometrical member for equally engaging against an interior of a well casing;

b. an internal hole centrally positioned in said member for accepting said drop pipe, said internal hole including an upper and lower rim, each of said rims having an increasing internal diameter from said center to an outer edge of said rim; and, c. locking means for engaging between said internal hole and said drop pipe, said locking means including an annular sharp pointed ridge extending outwardly from said internal hole and substantially surrounding a diameter of said internal hole whereby said locking means maintains said tri-spacer in a predetermined position on said drop pipe when said drop pipe is slid down into said well casing.

8. Tri-spacer of claim 7 wherein said locking means further comprises a serrated wedge and a strap attaching said serrated wedge to said member whereby said serrated wedge engages between said drop pipe and said internal hole and said upper rim.

9. Tri-spacer of claim 7 comprising a gap in said annular sharp pointed ridge.

10. Tri-spacer of claim 9 comprising vertical guide ridges on each side of said gap.

11. Tri-spacer of claim 10 comprising horizontal locating ridges on an upper rim next to each of said vertical guide ridges.

12. Tri-spacer of claim 10 comprising a horizontal ramp locking ridge between said vertical guide ridges and substantially in a plane substantially parallel to said annular pointed ridge.

13. Tri-spacer of claim 12 wherein said horizontal ramp locating ridge and said annular sharp ridge are in the same plane.

14. Tri-spacer of claim 8 wherein a channel is formed in a portion of said lower rim whereby said channel accepts said serrated insert wedge.

15. Tri-spacer for spacing a drop pipe in a well casing comprising:

a. plurality of tabular means extending equally outward from a center of a geometrical member for equally engaging against an interior of a well casing;

b. an internal hole centrally positioned in said member for accepting said drop pipe; and c. locking means for engaging between said internal hole and said drop pipe, said locking means including a triangular sharp pointed ridge extending outwardly from said internal hole and substantially surrounding said internal diameter, a horizontal ramp locking ridge extending outwardly from a gap in said ridge, and a serrated wedge including a strap attaching said serrated wedge to said member whereby said serrated wedge engages between said drop pipe and said horizontal locking ridge, and said triangular sharp pointed ridge acts between said internal hole and said upper rim thereby locking said tri-spacer in a predetermined position on said drop pipe when said drop pipe is slid down into said well casing.

* * * * *